US006633816B2

(12) United States Patent
Shirasaka et al.

(10) Patent No.: US 6,633,816 B2
(45) Date of Patent: Oct. 14, 2003

(54) BOREHOLE SURVEY METHOD UTILIZING CONTINUOUS MEASUREMENTS

(75) Inventors: Ichiro Shirasaka, Sugar Land, TX (US); Wayne Phillips, Houston, TX (US); Mauricio Tejada, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 10 days.

(21) Appl. No.: 09/904,946

(22) Filed: Jul. 13, 2001

(65) Prior Publication Data

US 2002/0060570 A1 May 23, 2002

Related U.S. Application Data

(60) Provisional application No. 60/219,772, filed on Jul. 20, 2000.

(51) Int. Cl.[7] ..... G01V 1/40; F21B 47/022

(52) U.S. Cl. ..... 702/6; 33/304

(58) Field of Search ..... 702/6; 33/304

(56) References Cited

U.S. PATENT DOCUMENTS

| | | | | |
|---|---|---|---|---|
| 4,812,977 A | * | 3/1989 | Hulsing, II | 702/6 |
| 4,987,684 A | | 1/1991 | Andreas et al. | |
| 5,103,920 A | | 4/1992 | Patton | |
| 5,128,867 A | | 7/1992 | Helm | |
| 5,155,916 A | | 10/1992 | Engebretson | |
| 5,435,069 A | | 7/1995 | Nicholson | |
| 5,452,518 A | | 9/1995 | DiPersio | |
| 5,519,668 A | | 5/1996 | Montaron | |
| 5,812,068 A | | 9/1998 | Wisler et al. | |
| 6,179,067 B1 | * | 1/2001 | Brooks | 175/45 |
| 6,233,524 B1 | | 5/2001 | Harrell et al. | |
| 6,272,434 B1 | | 8/2001 | Wisler et al. | |
| 6,321,456 B1 | | 11/2001 | McElhinnney | |
| 6,347,282 B2 | * | 2/2002 | Estes et al. | 702/6 |
| 6,381,858 B1 | * | 5/2002 | Shirasaka | 33/304 |
| 6,453,239 B1 | * | 9/2002 | Shirasaka et al. | 701/220 |
| 6,480,119 B1 | * | 11/2002 | McElhinney | 340/853.8 |
| 6,529,834 B1 | * | 3/2003 | Estes et al. | 702/9 |

FOREIGN PATENT DOCUMENTS

| | | |
|---|---|---|
| EP | 0654687 A2 | 5/1995 |
| GB | 2331811 A | 6/1999 |

OTHER PUBLICATIONS

European Search Report Application No. GB 0117499.4 dated Mar. 25, 2002.

* cited by examiner

*Primary Examiner*—John Barlow
*Assistant Examiner*—T. Le
(74) *Attorney, Agent, or Firm*—J. L. Jennie Salazar; Brigitte L. Jeffery; John Ryberg

(57) ABSTRACT

A borehole survey method is provided for processing continuous measurements of the earth's magnetic and gravitational fields obtained while drilling a borehole. The present invention improves borehole acquisition of targeted geological structures by substantially reducing continuous measurement errors attributable to noise, shock and vibrations from turning the drill bit against rock.

24 Claims, 4 Drawing Sheets

BOREHOLE SURVEY METHOD UTILIZING CONTINUOUS MEASUREMENTS

REFERENCE TO RELATED APPLICATION

This application claims priority to U.S. Provisional Application No. 60/219,772 filed on Jul. 20, 2000.

FIELD OF THE INVENTION

This invention relates generally to making downhole measurements during the drilling of a borehole to recover natural deposits of oil or gas and, more particularly, to using continuous downhole measurements to directionally drill the borehole.

DESCRIPTION OF THE RELATED ART

Oil and gas are commonly recovered from natural mineral deposits in subsurface geologic formations in the earth's crust. Drilling rigs at the surface are used to bore long, slender boreholes into the earth's crust to the location of the subsurface oil or gas deposits to establish fluid communication with the surface through the drilled borehole. The downhole drilling equipment used to drill boreholes may be directionally steered to known or suspected oil or gas deposits using directional drilling techniques, and the direction and orientation of downhole survey instruments are monitored at discrete survey stations along the borehole.

Surveying of boreholes is commonly performed using downhole survey instruments. These instruments typically contain sets of three orthogonal accelerometers and magnetometers which are coupled within a bottom hole assembly (BHA), which is in turn coupled in the drillstring from 20 to 200 feet above the drill bit. These survey instruments are used to measure the direction and magnitude of the local gravitational and magnetic field vectors in order to determine the azimuth and the inclination of the borehole at each survey station within the borehole. Generally, discrete borehole surveys are performed at survey stations along the borehole when drilling is stopped or interrupted to add additional joints or stands of drillpipe to the drillstring at the surface.

The trajectory of drilled boreholes within any segment of interest is generally determined by the mode of drilling and by the configuration of the drilling equipment that is used to drill the borehole at that segment of interest. In directional drilling using a bent sub and a mud motor, there are two modes of drilling that produce distinctive borehole trajectories. The first mode involves rotation of the entire drillstring, including the BHA that contains the survey instruments, and the drill bit that is coupled to the bottom (leading end) of the drillstring. This mode of drilling, with the bent sub in its aligned or straight configuration and the mud motor inactive, is known as "rotating." The second mode of drilling has the bent sub in its deployed or angular configuration with the drill bit being rotated by the active mud motor instead of rotating the drillstring. The mud motor is powered by pressurized drilling mud pumped down the hollow interior of the non-rotating drillstring. This mode of drilling is known as "sliding." Rotating produces a generally linear trajectory of the drilled borehole, although there are typically borehole deviations from true linear trajectory due to the effects of gravity, geologic heterogeneities, misalignment between the BHA and the borehole, stiffness of the drillstring and transition effects that occur due to switching from one drilling mode to the other. Drilling while sliding produces a curved trajectory of the drilled borehole generally conforming to an arc. Again, there are typically borehole deviations from true arc configuration of a borehole segment drilled by sliding due to the same factors that cause borehole deviations from linear trajectory with drilling by rotating.

Many factors may combine to unpredictably influence the trajectory of a drilled borehole. It is important to accurately determine the borehole trajectory in order to determine the position of the borehole at any given point of interest and to guide the borehole to its geological objective. "Position," as that term is used herein in reference to boreholes, indicates the total vertical depth, longitude and latitude of a point of interest. Surveying of a borehole using existing methods involves the intermittent measurement of the earth's magnetic and gravitational fields to determine the azimuth and inclination of the borehole at the BHA under static conditions; that is, while the BHA is stationary. These "static" surveys are generally performed at discrete survey "stations" along the borehole when drilling operations are suspended to make up additional joints or stands of drillpipe into the drillstring. Consequently, the along hole depth or borehole distance between discrete survey stations is generally from 40 to 90 feet or more corresponding to the length of joints or stands of drillpipe added at the surface.

Reliable measurements of the earth's magnetic and gravitational fields are available at the survey stations, and can be used to obtain reliable estimates of the azimuth and inclination of the borehole at the survey stations. Although the azimuth and inclination at a survey station of interest can be determined using measurements of the earth's magnetic and gravitational fields, the depth cannot be measured, and must be determined by other means. The vertical depth and position of a survey station is determined by mathematically combining the segments of the borehole between discrete survey stations starting with the surface location of the drilling rig and progressing downward to the geologic objective of the borehole. The problem is that undetected borehole variations occurring between discrete survey stations cause substantial errors in calculating the vertical depth and position of a survey station of interest. Undetected borehole variations accumulate as mathematical combination of borehole segments is used to calculate and track borehole vertical depth and position.

It would be beneficial, therefore, to detect borehole variations and to accurately model the trajectory of the borehole between discrete survey stations in order to determine and track the spatial position of the borehole relative to the geologic objective of the borehole. Existing borehole survey techniques use various methods, including the tangential method, balanced tangential method, equal angle method, cylindrical radius of curvature method and the minimum radius of curvature method, to model the trajectory of the borehole segments between survey stations. Generally, these existing methods model the trajectory of the borehole segments between discrete survey stations based on the assumptions that either the azimuth and inclination remains constant from one survey station to the next or, more often, that the azimuth and inclination of the borehole smoothly transition from the values measured at one survey station to those measured at the next survey station. For example, the minimum radius of curvature method models the borehole segment between survey stations based on the assumption that the trajectory of the borehole segment conforms to an imaginary true arc whose length corresponds to the through-borehole distance from the nearest uphole survey station to the nearest downhole survey station. The length of the arc is assumed to be equal to the length of the drillpipe added to the drillstring during drilling of the borehole segment of interest. These imaginary arcs, one for each defined borehole segment, are stringed and mathematically combined together in sequence, from the known surface location of the drilling rig to the bottom of the borehole, in order to estimate the vertical depth and position of the borehole at any given point of interest.

The inability of these existing borehole survey methods to detect and account for borehole deviations that occur between survey stations is problematic. Existing methods of surveying boreholes, including the minimum radius of curvature method, introduce significant error that lead to inaccurate determinations of borehole vertical depth and position resulting in substantial losses of otherwise recoverable reserves due to inaccurate steering of directional boreholes. Borehole surveys using existing survey methods to model the trajectory of borehole segments between survey stations introduce substantial vertical depth and position error, and the extent of the error depends on the extent to which undetectable borehole variations occur between survey stations.

The vertical depth and position of a point in a borehole is determined using existing methods based on measurements of the earth's magnetic and gravitation fields at survey location 32, the calculated depth, measurements of the earth's magnetic and gravitational fields at survey location 31, and the length of drillpipe fed into the borehole between the survey station 31 and survey station 32. The depth error introduced by undetected borehole variations can be illustrated by reference to FIG. 1 which shows a borehole 14 and a borehole variation 33 occurring within the borehole segment between a first survey station 31 and a second survey station 32. The undetected borehole variation 33 will result in the actual depth of survey station 32 being substantially different from the depth calculated. The presence of the undetected borehole variation 33 renders the depth calculation for survey station 32 inaccurate, and the integration of the inaccurate depth for survey station 32 into subsequent determinations of the depth at later survey stations accumulates depth errors that ultimately reduces the recovery of targeted reserves.

The survey instruments that reliably measure the earth's magnetic and gravitational fields at survey stations can also be used to obtain measurements of the earth's magnetic and gravitational fields during drilling operations. Drilling operations, as that term is used herein, means that the drill bit is being rotated against rock. Literally thousands of measurements of the earth's magnetic and gravitational fields can be obtained for each borehole segment using existing survey instruments. Successive measurements of the earth's magnetic and gravitational fields during drilling operations may be separated by only fractions of a second or thousandths of a meter and, in light of the relatively slow rate of change of the magnetic and gravitational fields in drilling a borehole, these measurements are continuous for all practical analyses. For this reason, the determination of azimuth and inclination of a borehole from measurements of the earth's magnetic and gravitational fields made during drilling operations are referred to herein as "continuous" measurements.

The problem is that the violent crushing and grinding of the drill bit against rock at the bottom of the borehole, the irregular interaction of the drillstring with the walls of the borehole, and even the constantly changing stresses in the connections between joints of drillpipe, all present during drilling operations, combine to contribute noise, shock and vibrations that severely contaminates continuously obtained measurements of the earth's magnetic and gravitational fields to the extent that this data is not useful in reliably determining the azimuth and inclination of the borehole at points between survey stations. If continuously obtained magnetic and gravitational field data could be effectively used, borehole deviations occurring between survey stations could be detected and accounted for in calculating and tracking the depth of the borehole.

What is needed is a method of processing magnetic and gravitational field data obtained while drilling to make it useful in determining borehole azimuth, inclination and depth. What is needed is a method of continuously surveying the borehole during drilling in order to better detect and account for borehole variations resulting from gravity, geological heterogeneities, stiffness of the drillstring, interaction of the drillstring with the walls of the borehole and from transition effects of switching from sliding mode of drilling to rotation mode of drilling. What is needed is a method of either eliminating or dramatically reducing the time between reliable borehole surveys to prevent depth errors in directional drilling. What is needed is a method of continuously predicting future borehole trajectory using continuous borehole survey data, and of reconciling borehole trajectory predictions with borehole azimuth and inclination data obtained at survey stations in order to improve the accuracy of directional drilling. What is needed is a method of processing magnetic and gravitational field measurements obtained during drilling to reduce or eliminate the effects of shock, vibration and noise.

It is desirable that the method of continuously surveying the borehole while drilling use existing survey instruments and existing mud telemetry equipment commonly used with existing directional drilling methods. It is further desirable that the method of continuously surveying the borehole during drilling use existing data processing and computer equipment and software commonly used in connection with conventional borehole survey methods.

SUMMARY OF THE PRESENT INVENTION

The present invention provides a borehole survey method that utilizes continuous measurements of the earth's magnetic and gravitational fields obtained while actively drilling the borehole. The continuously obtained survey data is transmitted to the surface using mud telemetry systems. The continuously obtained survey data may be processed using downhole micro processors, or it may be first transmitted to the surface and there processed using computers to refine the data and eliminate or reduce error from unwanted shock, vibrations and nose from drilling. The present invention improves the accuracy of borehole spatial and positional computations by improving the accuracy of estimations of borehole vertical depth and position using integration of borehole surveys.

The objective of the present invention is to augment existing methods of modeling a drilled borehole, such as the minimum radius of curvature calculation, with effective estimates of the earth's magnetic and gravitational fields obtained by processing measurements obtained while drilling. In one method of the present invention, a log of continuous azimuth and continuous inclination data is created, and the log is divided into sections delineated in time by discrete survey stations. The measurements of the earth's magnetic and gravitational data within these delineated sections are then smoothed using windowed median smoothing to eliminate random noise caused by shock and vibration. Mathematical interpolation between adjacent smoothed magnetic and gravitational field measurements, or between adjacent smoothed azimuth and inclination data derived from magnetic and gravitational field measurements, is performed to determine a synthetic azimuth and inclination corresponding to a desired depth of interest corresponding to a survey station. The synthetic magnetic and gravitational field measurements, or the azimuth and inclination derived therefrom, is compared to the more reliable measurements of magnetic and gravitational fields obtained at survey stations in order to determine an offset correction, which is then used to adjust the continuously obtained magnetic and gravitational field measurements. Existing methods, such as the minimum radius of curvature calculation, may then be used to process the corrected measurements, and the resulting spatial and positional computations provide superior direction of the borehole to the desired target.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

In the drawings:

FIG. 1 shows a typical drilling operation comprising a drilling rig, a drillstring including a survey instrument, a drilling mud circulating system and a data processor;

FIG. 2 is a schematic illustration of a survey instrument showing the origin of the tool-fixed coordinate system used in borehole surveys;

FIG. 3 is schematic showing a borehole deviation occurring between two discrete survey stations at which conventional azimuth and inclination data are generally obtained from discrete measurements of the earth's magnetic and gravitational fields;

FIG. 4 is a flow chart showing the data processing steps of the present invention; and FIG. 5 is a graphical representation of the results obtained using the present invention.

DETAILED DESCRIPTION OF THE PRESENT INVENTION

The present invention provides a method of processing either continuously obtained raw magnetic and gravitational field measurements or, in the alternative, azimuth and inclination estimates obtained using continuously obtained magnetic and gravitational field measurements made during the drilling of a borehole. "Azimuth data," "inclination data" and "azimuth and inclination data," as those terms are used herein, mean either the raw measurements of the earth's magnetic and gravitational fields or the estimates of borehole azimuth and inclination obtained using such raw measurements of the earth's magnetic and gravitational fields. It is within the scope of this invention to either process the raw magnetic and gravitational field measurements obtained during drilling of a borehole, or to process estimates of azimuth and inclination of the borehole obtained from raw magnetic and gravitational field measurements. The present invention can be effectively used in either case, and the decision as to whether to process raw magnetic and gravitational field measurements using the present invention to obtain refined magnetic and gravitational field measurements for use in determining azimuth and inclination of the borehole, or to use the present invention to process azimuth and inclination estimates obtained using raw magnetic and gravitational field measurements, should be based on telemetry capacity, microprocessor capacity and other considerations.

The azimuth and inclination data is obtained using conventional survey instruments, and is transmitted to the surface using conventional measurement while drilling (MWD) instruments. The survey instruments and the MWD instruments are included in a bottom hole assembly (BHA) that is run into a borehole in a drillstring comprising connected joints of tubular pipe and having a drill bit at its bottom, leading end. The drillstring is coupled at the surface to a drilling rig which provides torque for rotating the drillstring.

Figure 1:
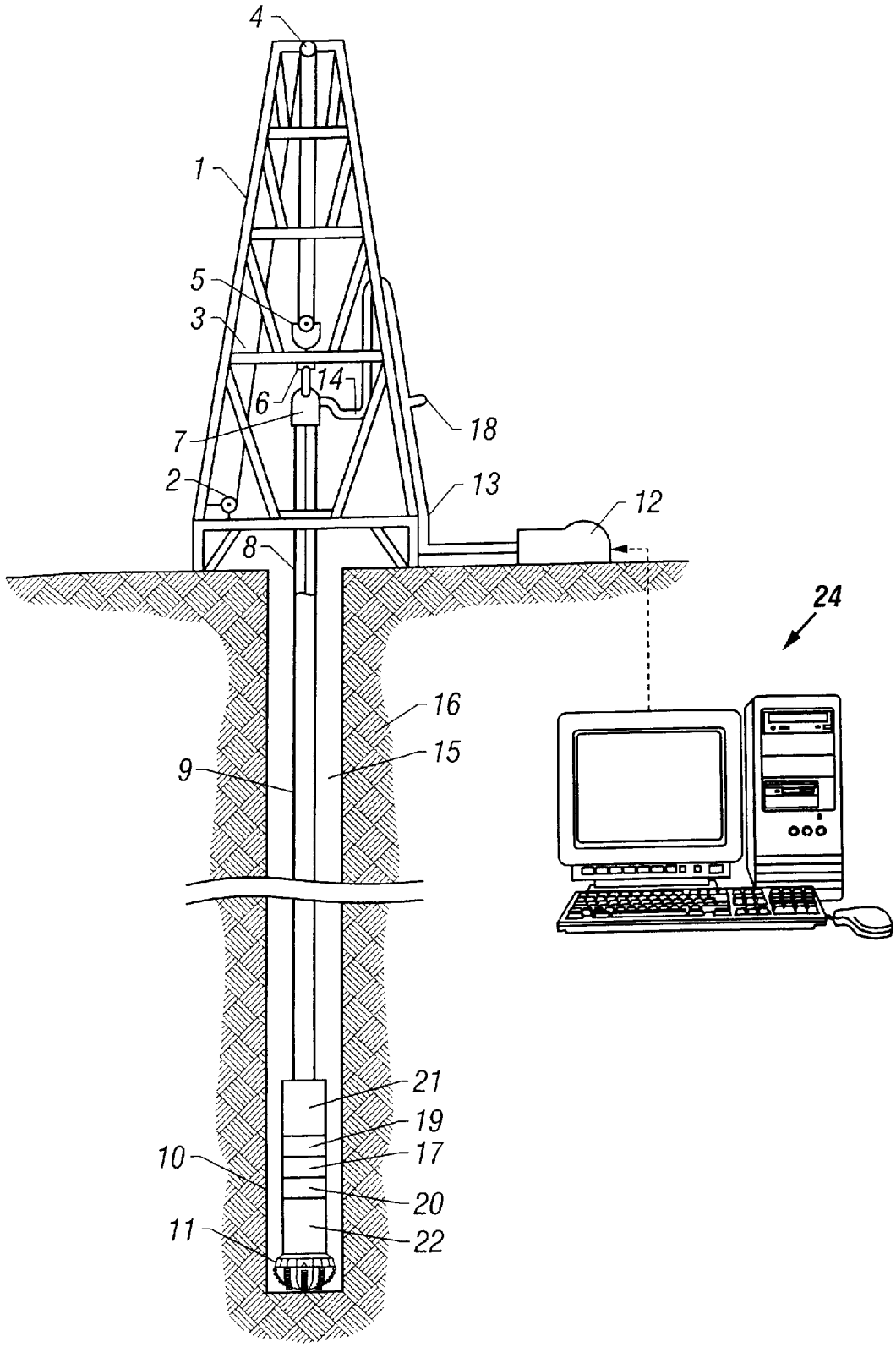

FIG. 1 is a depiction of a typical drilling rig engaged using the described drillstring to drill a borehole. The drilling equipment includes a derrick 1, drawworks 2, cable 3, crown block 4, traveling block 5, and hook 6, supporting a drillstring which includes a swivel joint 7, kelly 8, drillpipe 9, drill collars 10, and drill bit 11. Mud pumps 12 circulate drilling fluid through a standpipe 13 and flexible hose 14, down through the hollow drillstring and back to the surface through the annular space 15 between the drillstring and the borehole wall 16.

Figure 2:
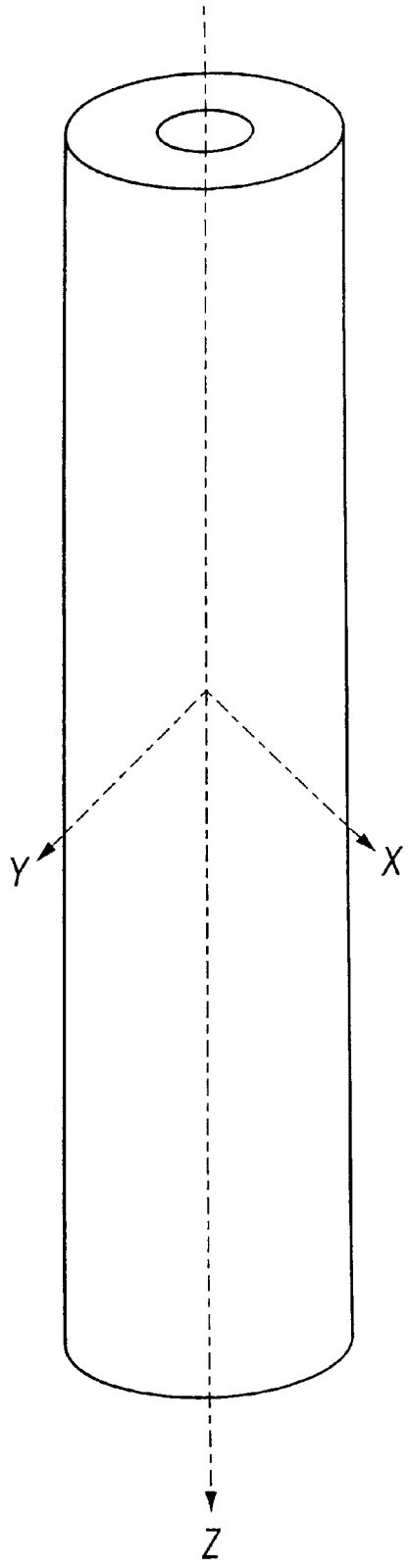
Figure 3:
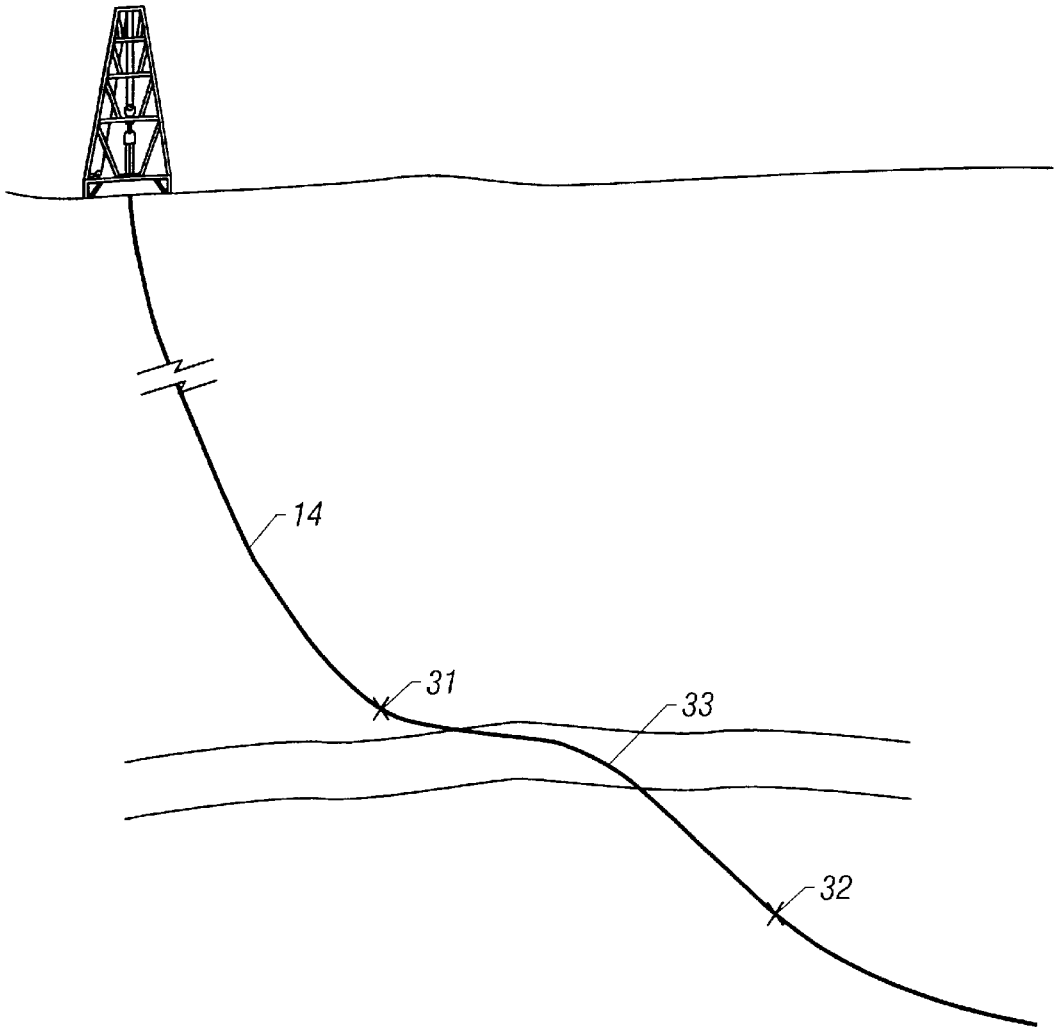

During the course of drilling a borehole for oil or gas production, it is advantageous to measure, from time to time, the orientation of the angle and borehole in order to determine its trajectory and to directionally guide the borehole to its subsurface objective. The present invention and existing methods use the survey tool 17 located within the drill collars 10 for measuring the direction and magnitude of the earth's local gravitational and magnetic fields with respect to a tool-fixed coordinate system having its origin within the survey tool as shown in FIG. 2. Measurements of the earth's magnetic and gravitational fields are used to estimate the azimuth and inclination of the borehole at a point of interest. The present invention and existing methods may also make use of gyroscopes. Using existing methods, it is customary to take at least one survey each time drilling operations are interrupted to add a new section of drillpipe to the drillstring at the surface.

The minimum radius of curvature method is commonly used to approximate the borehole segment between survey stations as an arc of length equal to the amount of drillpipe added to the drillstring between the successive measurements at the survey stations. The vertical depth and position of the borehole is estimated using this approximation of the borehole segment as an arc and using integration of all prior estimations for uphole borehole segments. The failure of existing methods to account for borehole deviations causes substantial error in borehole vertical depth and position estimate. The error is greater as the length of the borehole segment between the survey stations increases. The present invention enables the use of the survey instruments to continuously survey the position of the borehole and to thereby improve directional control of the drilled borehole. Again referring again to FIG. 1, the measured azimuth and inclination data measured by the survey tool 17 are transmitted to the surface by modulating a valve (not shown) placed in the drilling mud flow passage within or adjacent to the survey tool 17, causing pressure pulses to propagate in the mud column up the drillstring, where they are detected by a pressure transducer 18 placed in the standpipe 13 and communicated to data processing system 24 which may be located on the rig floor, in a nearby logging trailer or other work area. The data processing system 24 is programmed to interpret the pressure pulses, eliminate the influence of bias error components and calculate one or more conventional wellbore orientation indicators. Azimuth and inclination measurements obtained while drilling are so corrupted by shock, vibration and noise from the drilling process that the data transmitted by mud telemetry to the data processor is unusable. The present invention involves programming the data processing system 24 to refine and process continuously obtained azimuth and inclination data collected at the survey tool 17 during drilling operations to decontaminate data corrupted by these telemetry acquisition errors. Although mud telemetry is the preferred method of communicating data uphole to the data processor programmed in accordance with the present invention, other methods and devices for communicating data uphole, such as electromagnetic methods or acoustic signals in the drillstring, could also be used and are intended to be within the scope of the invention.

The borehole inclination at any given point can be determined by use of the gravitational measurements alone. The borehole azimuth at any given point can be determined from both the gravitational and magnetic measurements. When drilling operations are suspended to add joints of pipe to the drillstring at the surface, borehole azimuth and inclination data may be reliably obtained and stored in the survey instrument 17 until operation of the fluid circulating pumps is restored and the recorded data can be reliably transmitted uphole using mud telemetry. However, azimuth and inclination data obtained and transmitted to the surface using mud telemetry during drilling operations is severely corrupted to the point of being useless under existing borehole survey methods. The principal sources of uncertainty in azimuth and inclination data obtained during drilling operations are shock, vibrations and noise from the drilling process that interfere with transmission of azimuth and inclination data using mud telemetry.

The present invention uses one or more data processors to implement a series of steps to refine azimuth and inclination measurements taken while drilling between survey stations to improve the accuracy of borehole positional computations. The objective of the present invention is to augment the minimum radius of curvature calculation with effective estimates of the continuous azimuth and inclination measurements. Continuous measurements of the azimuth and inclination while drilling can be used to continuously calculate the azimuth, inclination and depth of the borehole, and to detect and account for borehole deviations occurring between survey stations. The minimum radius of curvature method is then applied to refined measurements of azimuth and inclination, and the differences between fine arcs and straight tangents are minimal since the fine arc approaches a straight tangent as a mathematical limit as the through-borehole distance between successive azimuth and inclination measurements approaches zero. Using the present invention, the systematic error in the depth estimate in the conventional, stationary surveys can be avoided. Thus, the present invention improves the accuracy of determinations of the integrated borehole position.

While the continuous survey measurements are primarily filtered, they are generally less accurate than the survey measurements obtained at survey stations when drilling is stopped because the survey instruments and telemetry systems used to measure and transmit data to the surface are adversely affected by shock, vibrations and noise resulting from interaction of the nearby drilling bit with rock, from mud motor operation, and from the interaction of the rotating and/or sliding drillstring with the walls of the borehole. These measurement errors resulting from shock, vibration and noise have prevented the reliable use of continuously obtained azimuth and inclination data, but this obstacle is overcome using the present invention.

Figure 4:
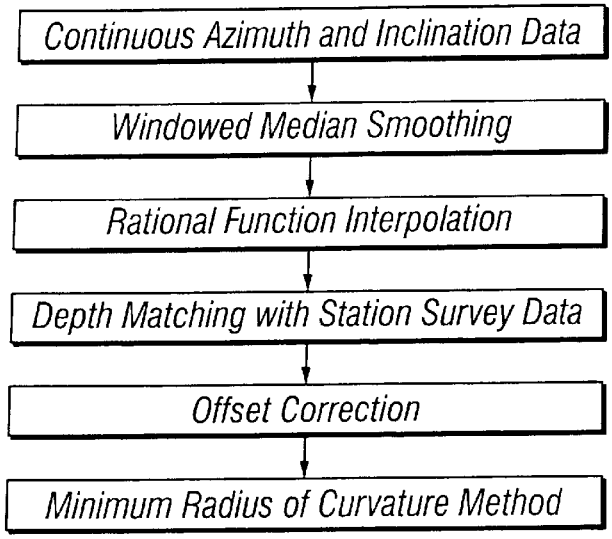

The steps of the present invention for processing continuously obtained data are shown in the flowchart in FIG. 4. The first step in refining continuously obtained azimuth and inclination data involves the elimination of data corruption resulting from measurement errors so that a reliable estimate of the true azimuth or inclination can be obtained. Estimates of azimuth and inclination obtained by processing continuous measurements of the earth's magnetic and gravitational fields using moving window averaging are unreliable because the data fails to provide a discernable central tendency within the data distribution profile. This failure is attributable to errors in the mean value within a window caused by outlying data; that is, measurements that are so affected by shock, noise or vibration that they fall far beyond the bounds of a grouping of measurements obtained within a relatively small window of time or depth. In the present invention, the continuous azimuth and inclination data obtained while drilling can be substantially smoothed to reduce or eliminate the effects of measurement errors using windowed median smoothing.

Previous efforts to use continuously obtained data involve averaging azimuth (or inclination) data during a moving time window to estimate the true azimuth (or inclination) at a given borehole depth from the average of the values obtained during a selected time period. However, continuously obtained azimuth (or inclination) data could not be efficiently utilized using this method because, although the obtained measurements within a selected time window may roughly group or center around the true azimuth (or inclination) value at that location in the borehole, the first moment of the data probability distribution tails is large in its window; that is, there is insufficient separation between the probability distribution tails adjacent to the center of the probability distribution of data and the center to provide a discernable spike corresponding to the true azimuth (or inclination) value. Processing continuously obtained azimuth (or inclination) data within a selected time window using windowed median smoothing rather than a moving average provides a more robust estimator of the true azimuth (or inclination) at the corresponding location in a borehole because it is less affected by outlying measurements within the data set.

The optimal number of azimuth (or inclination) measurements to be included within a selected time window depends on the frequency with which measurements are made, the extent to which telemetry acquisition errors have corrupted the data and the available capacity of the telemetry system and the data processor. While selecting a large number of measurements, for example 21 or more, benefits decontamination of telemetry acquisition errors in the data, the ability to obtain accurate resolution may be lost. Selecting a small number of measurements, for example 3 or less, may introduce uncertainty due to the greater influence of any given measurement that may be significantly affected by telemetry acquisition errors. The present invention provides best results when the number of azimuth (or inclination) measurements is between 3 and 21, more preferably between 5 and 13, and most preferably between 7 and 11, inclusive.

The ascertainable median value obtainable by processing measured data for azimuth (or inclination) occurring within a selected time window using the windowed median technique can be mathematically determined and adapted for application using the data processor. The median of a probability distribution function p(x) is the value $\mu_{1/2}$ which is defined as that value for which, in the limit of an infinite number of samples $x_i$, half the samples will be less than the median and half will be greater, i.e. in terms of the probability, $$\int_{-\infty}^{\mu_{1/2}} p(x)\,dx = \int_{\mu_{1/2}}^{\infty} p(x)\,dx = 1/2.$$

Let $x_1, X_2, \ldots, X_N$ be a sequence of azimuth (or inclination) data, then if the data $x_1, X_2, \ldots, X_N$ are sorted to the new sequence $\{x'_j\}$, j=1, 2, . . . , N, in their ascending (or descending) order, then the median of the data is given by $$\mu_{1/2} = x'_{(N+1)/2}, \quad \text{if } N \text{ is odd;}$$
$$= \frac{1}{2}[x'_{N/2} + x'_{(N/2)+1}], \quad \text{otherwise.}$$

The windowed median is the iteration of the above sorting process to find the median in a sliding data window whose length is N. The k-th window $W_k$ is defined by $$W_k = \{x_k, x_{k+1}, \ldots, x_{k+N-1}\}.$$

Now, let $W'_k$ be an ordered set $W'_k = \{x'_k, x'_{k+1}, \ldots, x'_{k+N-1}\}$ obtained by sorting the data within window $W_k$. in the ascending (or descending) order. Then the median of the data of window $W_k$ is given by $$\mu_{1/2}^{(k)} = x'_{k+(N-1)/2}, \quad \text{if } N \text{ is odd;}$$
$$= \frac{1}{2}[x'_{k+(N/2)-1} + x'_{k+(N/2)}], \quad \text{otherwise.}$$

In the next time-step, all but one of the date in window $W_k$ moves into the next window $W_{k+1}$ such that $$W_{k+1} = \{x_{k+1}, x_{k+2}, \ldots, x_{k+N}\}.$$

Then, the ordered set obtained by sorting windows $W_{k+1}$ $$W'_{k+1} = \{x'_{k+1}, x_{k+2}, \ldots, x_{k+N}\}.$$

Thereby, the median of the data of window $W_{k+1}$ is $$\mu_{1/2}^{(k+1)} = x'_{k+1+(N-1)/2}, \quad \text{if } N \text{ is odd;}$$
$$= \frac{1}{2}[x'_{k+(N/2)} + x'_{k+(N/2)+1}], \quad \text{otherwise.}$$

The windowed median smoothing step can be performed using the data processor 24 at the surface or downhole microprocessors.

The next step of the present invention for processing continuously obtained azimuth and inclination data is designed to enable the correlation of windowed median smoothed azimuth and inclination data to sets of data pairs obtained using conventional borehole surveys performed at conventional survey stations along the borehole. This step is necessary because the continuously obtained survey data must correlate to a known depth and related known survey data obtained at a survey station in order to obtain the full benefit of the present invention. A reliable offset correction can be determined by matching survey station data and continuously obtained data, and applied to continuously correct data as it is continuously obtained. Since none of the continuously obtained measurements may correlate exactly to the depth at which survey station measurements were made, an offset correction is obtainable by synthesizing matching data using interpolation; that is, the smoothed continuous azimuth and inclination data are interpolated by monotonically ascending depth values as abcissa with a minimum depth interval Δx. In this manner, the survey station depth value serves as a reference point for determination, by interpolation or extrapolation of smoothed data, the needed offset correlation used to adjust the smoothed azimuth and inclination data for offset.

Rational function interpolation or extrapolation can provide a robust approximation method to go through a set of tabulated functional values such as, in this case, the smoothed continuous azimuth versus depth, or smoothed continuous inclination versus depth. Again, this second processing step can be adapted for programming using the data processor.

A rational function passing through M+1 points $(x_k, y_k)$, $(x_{k+1}, y_{k+1})$, . . . , $(x_{k+M}, y_{k+M})$ is denoted by $R_{k(k+1)\ldots(k+M)} = R_{k(k+1)\ldots(k+M)}(x)$. Using the Bulirsch and Stoer algorithm to obtain the recurrence relation $$R_{k(k+1)\ldots(k+M)} = R_{(k+1)\ldots(k+M)} + \frac{R_{(k+1)\ldots(k+M)} - R_{k(k+1)\ldots(k+M-1)}}{\frac{x - x_k}{x - x_{k+M}}\left[1 - \frac{R_{(k+1)\ldots(k+M)} - R_{k(k+1)\ldots(k+M-1)}}{R_{(k+1)\ldots(k+M)} - R_{(k+1)\ldots(k+M-1)}}\right] - 1},$$

where $R_{k(k+1)\ldots(k+M)} = R_k = y_k$, when M=0; and $R_{k(k+1)\ldots(k+M)} = 0$, when M=−1.

The above recurrence can be converted to one involving the small differences:

$$S_{M,k} \equiv R_{k(k+1)\ldots(k+M)} - R_{k(k+1)\ldots(k+M-1)}$$

$$T_{M,k} \equiv R_{k(k+1)\ldots(k+M)} - R_{(k+1)\ldots(k+M)}$$

which satisfy the relation $$S_{M+1,k} - T_{M+1,k} = S_{M,k+1} - T_{M,k}.$$

Then, from the above recurrence relation of the Bulirsch and Stoer algorithm, it follows that $$T_{M+1,k} = \frac{S_{M,k+1}(S_{M,k+1} - T_{M,k})}{\frac{x - x_k}{x - x_{k+M+1}} T_{M,k} - S_{M,k+1}},$$

$$S_{M+1,k} = \frac{\frac{x - x_k}{x - x_{k+M+1}} T_{M,k}(S_{M,k+1} - T_{M,k})}{\frac{x - x_k}{x - x_{k+M+1}} T_{M,k} - S_{M,k+1}}.$$

Here, $x_k, X_{k+1}, \ldots, x_{k+M}$ are consecutive depth values in the continuous measurements, and $y_k, y_{k+1}, \ldots, y_{k+M}$ are the corresponding azimuth (or inclination) values. For those tabulated functional values, the rational function $R_{k(k+1)\ldots(k+M)} = R_{k(k+1)\ldots(k+M)}(x)$ effectively approximates the value y such that $y_k \leqq y \leqq y_{k+M}$ for any x such that $x_k \leqq x \leqq x_{k+M}$. Here, the (dense) series of x is generated by $x = x_k + m\Delta x$ for some integers $0 < m < |x_{k+M} - x_k|/\Delta x$.

In order to obtain the needed offset correction, we must match synthetic data, obtained by interpolating the smoothed azimuth (or inclination) data, to survey station data at the exact same depth. This step can be adapted for programming if we let $U \equiv \{(x_k, y_k) | 1<k<N\}$ be a set of the interpolated depth-azimuth (or depth-inclination) pairs based on the continuous measurements for the entire borehole trajectory. Let $V \equiv \{(X_i, Y_i | 1<i<M\}$ be a set of the depth-azimuth (or depth-inclination) pairs in the station survey. Obviously, M<N. Then, there is a unique subset U* of U such that $U^* = \{(x^*_i, y^*_i) | x^*_i = X_i, 1<i<\}$. Now, let $\alpha_i \equiv y_i^* - Y_i$. Here, $\alpha_i$, 1<i<M represent the offset values derived from the matching subset U* and the station survey set V.

Next, we define a subset $$U^{(i)} \equiv \left\{(x_n^{(i)}, y_n^{(i)}) \,\middle|\, x_i^* \equiv x_1^{(i)} \le x_2^{(i)} \le \ldots \le x_{N^{(i)}-1}^{(i)} \le x_{N^{(i)}}^{(i)} \equiv x_{i+1}^*,\ 1 \le n \le N^{(i)}\right\},$$

where $N^{(i)}$ is some integer. Then we set $$\beta_n^{(i)} = \alpha_i \frac{x_{i+1}^* - x_n^{(i)}}{x_{i+1}^* - x_i^*} + \alpha_{i+1} \frac{x_i^* - x_n^{(i)}}{x_i^* - x_{i+1}^*}.$$

Now, we obtain the offset correction as:

$$\tilde{y}_n^{(i)} = y_n^{(i)} - \beta_n^{(i)},\ 1 \le n \le N^{(i)}.$$

Finally, the offset correction set Σ of the continuous measurements for the entire trajectory is given by $$\Sigma = \bigcup_{1 \le i \le M} \left\{\left(x_n^{(i)}, \tilde{y}_n^{(i)}\right) \,\middle|\, 1 \le n \le N^{(i)}\right\}.$$

Figure 5:
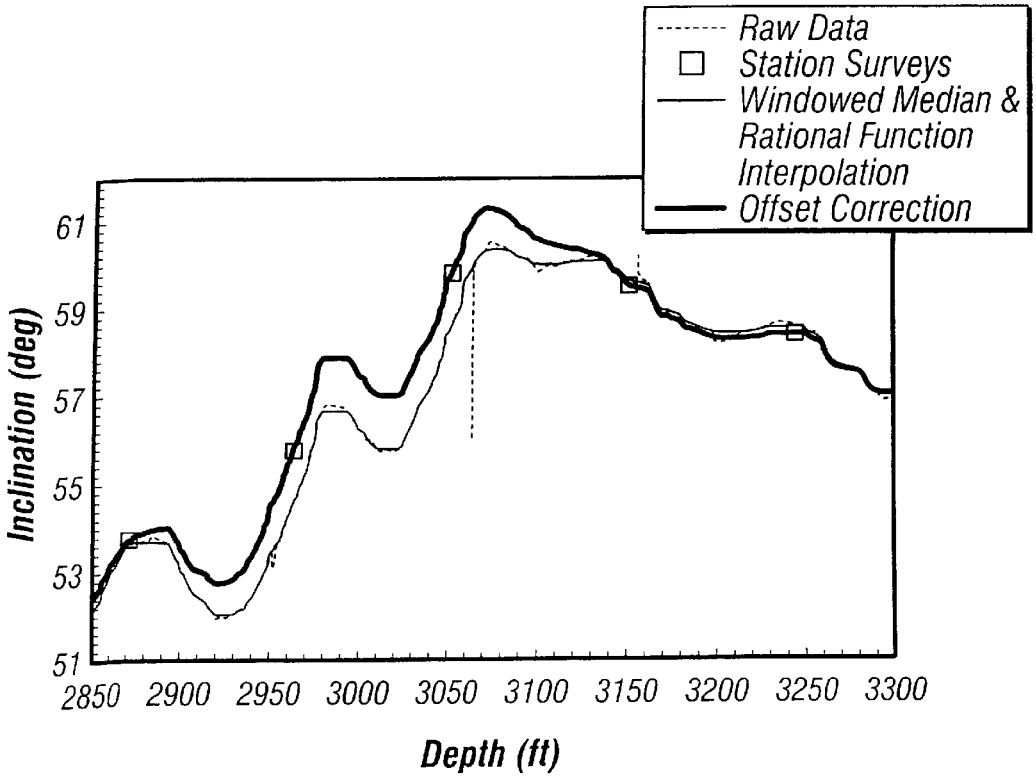

This completes the offset correction of the interpolated azimuth and (or inclination) data from the windowed median smoothing of the continuous measurements with respect to the station survey data. A graphical example of the above sequence of the data processing specific to the continuous inclination is shown in FIG. 5.

The final step of the present invention involves application of the minimum radius of curvature method to successive offset corrected and depth-correlated azimuth (or inclination) data provided by windowed median smoothing and rational function interpolation or extrapolation of the continuous measurements. As stated earlier, fine arcs become straight lines as the length approaches zero, and the relatively slow changes in borehole trajectory as compared to adjacent data measurements simplify modeling. The achieved objective is to obtain a continuous trajectory and geometry of the borehole based on the continuous azimuth and inclination measurements. This final step can be mathematically adapted for programming using a data processor.

Let $\Sigma_A$ and $\Sigma_D$ be sets of the offset corrections of the continuous azimuth and inclination data, respectively. Then the two sets are denoted by $$\Sigma_A = \bigcup_{1 \le i \le M} \left\{\left(x_n^{(i)}, \tilde{a}_n^{(i)}\right) \,\middle|\, 1 \le n \le N^{(i)}\right\}, \quad \text{and}$$

$$\Sigma_D = \bigcup_{1 \le i \le M} \left\{\left(x_n^{(i)}, \tilde{d}_n^{(i)}\right) \,\middle|\, 1 \le n \le N^{(i)}\right\},$$

respectively. Here we can apply the standard minimum curvature algorithm for the continuous data to calculate the trajectory. Namely, a ratio factor ρ is then given by $$\rho = \frac{2}{\kappa} \tan \frac{\kappa}{2},$$

where $$\cos \kappa = \cos \tilde{d}_n^{(i)} \cos \tilde{d}_{n+1}^{(i)} + \sin \tilde{d}_n^{(i)} \sin \tilde{d}_{n+1}^{(i)} \cos (\tilde{a}_{n+1}^{(i)} - \tilde{\alpha}_n^{(i)})$$

is defined as the borehole variation. By definition, put $\Delta x = x^{(i)}_{n+1} - x^{(i)}_n$ = constant. Then the coordinates of the consecutive trajectory-segment between n and n+1 in $[1, N^{(i)}]$ for some i are now given as follows:

For the true vertical depth (TVD) segment $Z_n^{(i)}$, $$Z_n^{(i)} = \frac{\rho \Delta x}{2}\left(\cos \tilde{d}_{n+1}^{(i)} + \cos \tilde{d}_n^{(i)}\right).$$

For the east longitude segment $\alpha_n^{(i)}$, $$\lambda_n^{(i)} = \frac{\rho \Delta x}{2}\left(\sin \tilde{d}_n^{(i)} \sin \tilde{a}_n^{(i)} + \sin \tilde{d}_{n+1}^{(i)} \sin \tilde{a}_{n+1}^{(i)}\right).$$

For the north latitude segment $L^{(i)}_n$, $$L_n^{(i)} = \frac{\rho \Delta x}{2}\left(\sin \tilde{d}_n^{(i)} \cos \tilde{a}_n^{(i)} + \sin \tilde{d}_{n+1}^{(i)} + \cos \tilde{a}_{n+1}^{(i)}\right).$$

Integrations of the above segments for all $n \in [1, N^{(i)}-1]$ and $i \in [1, M-1]$ will give the trajectory and geometry of a borehole based on the continuous azimuth and inclination measurements.

In view of the foregoing it is evident that the present invention is well adapted to attain all of the objects and features hereinabove set forth, together with other objects and features which are inherent in the methods disclosed herein.

As will be readily apparent to those skilled in the art, the present invention may easily be produced in other specific forms and methods without departing from its spirit or essential characteristics. The present method is, therefore, to be considered as merely illustrative and not restrictive. The scope of the invention is indicated by the claims that follow rather than the foregoing description, and all changes which come within the meaning and range of equivalence of the claims are therefore intended to be embraced therein.

We claim:

1. A method of surveying a borehole comprising using continuous downhole measurements of the earth's magnetic and gravitational fields obtained while turning a drill bit to deepen the borehole and processing the measurements using windowed median smoothing.

2. The method of claim 1 wherein the measurements of the earth's magnetic and gravitational fields are obtained using accelerometers and magnetometers.

3. The method of claim 1 wherein the continuous measurements are obtained using a gyroscope.

4. The method of claim 1 further comprises processing one of the measurements, survey data generated from the survey and combinations thereof using windowed median smoothing.

5. The method of claim 4 wherein the continuous measurements of the earth's magnetic and gravitational fields are used to estimate azimuth and inclination of a borehole.

6. The method of claim 4 wherein the processing survey data comprises using windowed median smoothing to decontaminate continuous measurements of the earth's magnetic and gravitational fields obtained while turning a drill bit to deepen the borehole.

7. The method of claim 6 further comprising comparing the smoothed measurements of the earth's magnetic and gravitational fields to borehole survey data obtained while the drill bit is not turned.

8. The method of claim 7 further comprising using interpolation of the smoothed measurements of the earth's magnetic and gravitational fields to ensure depth correlation of measurements obtained while turning the drill bit to measurements obtained while the drill bit is not turned.

9. The method of claim 7 further comprising using extrapolation of the smoothed measurements of the earth's magnetic and gravitational fields to ensure depth correlation of measurements obtained while turning the drill bit to measurements obtained while the drill bit is not turned.

10. The method of claim 4 wherein processing survey data comprises:

(a) smoothing measurements of the earth's magnetic and gravitational fields obtained while drilling a borehole by windowed median smoothing;

(b) interpolating the smoothed measurements of the earth's magnetic and gravitational fields;

(c) comparing interpolated measurements or the earth's magnetic and gravitational fields to conventional measurements at a common depth to obtain an offset collection; and (d) adjusting the smoothed measurements of the earth's magnetic and gravitational fields using the offset correction;

wherein the conventional measurements arc obtained while drilling of the borehole is temporarily suspended.

11. The method of claim 10 wherein the measurements of the earth's magnetic and gravitational fields are sent by telemetry to a surface processor and the surface processor is adapted to perform steps (a), (b), (c) and (d).

12. The method of claim 10 further comprising using the minimum radius of curvature algorithm applied to the adjusted measurements to model the trajectory or a segment of a borehole.

13. The method of claim 10 wherein the offset correction is calculated as the difference between the interpolated measurements and the corresponding depth measurements measured while drilling of the borehole is temporarily suspended.

14. The method or claim 10 wherein the smoothed measurements of the earth's magnetic and gravitational fields comprise continuously obtained measurements within a selected time window.

15. The method of claim 10 wherein the measurements of the earth's magnetic and gravitational fields arc obtained using accelerometers and magnetometers.

16. The method of claim 10 wherein the number of measurements or the earth's magnetic and gravitational fields smoothed is between 3 and 21, inclusive.

17. The method of claim 10 wherein the number of measurements of the earth's magnetic and gravitational fields smoothed is between 5 and 13, inclusive.

18. The method of claim 10 wherein the number of measurements of the earth's magnetic and gravitational fields smoothed is between 7 and 11, inclusive.

19. The method of claim 4 wherein the continuous measurements are obtained using a gyroscope.

20. The method of claim 4 wherein the processing survey data comprising using windowed median smoothing to decontaminate continuous measurements of azimuth and inclination of a borehole obtained while turning a drill bit to deepen the borehole.

21. The method of claim 4 wherein the processing borehole survey measurements comprises:

(a) smoothing measurements of azimuth and inclination of a borehole obtained while drilling the borehole by windowed median smoothing;

(b) interpolating the smoothed measurements of azimuth and inclination;

(c) comparing interpolated measurements of azimuth and inclination to conventional measurements at a common depth to obtain an offset correction; and (d) adjusting the smoothed measurements of azimuth and inclination using the offset correction;

wherein the conventional measurements are obtained while drilling of the borehole is temporarily suspended.

22. The method of claim 21 wherein the smoothed measurements of azimuth and inclination comprise continuously obtained measurements within a selected time window.

23. The method of claim 21 wherein the number of measurements of azimuth and inclination smoothed is between 7 and 11, inclusive.

24. The method of claim 4 wherein the processing continuous downhole measurements of azimuth and inclination of a borehole is by windowed median smoothing.

* * * * *